US009643248B2

(12) United States Patent
Bhattacharya

(10) Patent No.: US 9,643,248 B2
(45) **Date of Patent: *May 9, 2017**

(54) IMPACT PAD, TUNDISH AND APPARATUS INCLUDING THE IMPACT PAD, AND METHOD OF USING SAME

(71) Applicant: ArcelorMittal Investigacion y Desarrollo, S.L., Sestao (ES)

(72) Inventor: Tathagata Bhattacharya, Munster, IN (US)

(73) Assignee: ArcelorMittal Investigacion y Desarrollo, S.L. (ES)

( * ) Notice: Subject to any disclaimer, the term of this patent is extended or adjusted under 35 U.S.C. 154(b) by 0 days.

This patent is subject to a terminal disclaimer.

(21) Appl. No.: 15/049,866

(22) Filed: Feb. 22, 2016

(65) Prior Publication Data

US 2016/0167125 A1 Jun. 16, 2016

Related U.S. Application Data

(63) Continuation of application No. 14/510,789, filed on Oct. 9, 2014, now Pat. No. 9,308,581.

(60) Provisional application No. 62/037,949, filed on Aug. 15, 2014, provisional application No. 61/971,876, filed on Mar. 28, 2014.

(51) Int. Cl.

| | |
|---|---|
| ***B22D 41/00*** | (2006.01) |
| ***B22D 11/10*** | (2006.01) |
| ***B22D 11/01*** | (2006.01) |
| *B22D 11/00* | (2006.01) |

(52) U.S. Cl.

CPC ..... *B22D 41/003* (2013.01); *B22D 11/01* (2013.01); *B22D 11/10* (2013.01); *B22D 11/001* (2013.01); *B22D 41/00* (2013.01)

(58) Field of Classification Search

CPC ..... B22D 41/003

USPC ..... 164/437; 222/594; 266/275

See application file for complete search history.

(56) References Cited

U.S. PATENT DOCUMENTS 4,715,586 A 12/1987 Schmidt et al.
4,776,570 A * 10/1988 Vo Thanh ..... B22D 41/003 266/229

(Continued)

FOREIGN PATENT DOCUMENTS

DE EP 0184634 A1 * 6/1986 ..... B22D 41/003
DE 10202537 C1 1/2003

(Continued)

OTHER PUBLICATIONS

EPO machine translation of WO 2006094584 A1, Sep. 14, 2006.*

(Continued)

*Primary Examiner* — Kevin E Yoon
(74) *Attorney, Agent, or Firm* — Berenato & White, LLC

(57) ABSTRACT

A tundish impact pad, a tundish containing the same, and a method of using and assembly containing the impact pad and tundish are provided. The tundish impact pad features a base having a base surface with a conical impact surface area establishing an apex, a sidewall, and a top wall extending inwardly relative to the sidewall to terminate at an inner edge establishing a mouth opening spaced above and centered relative to the apex. The top wall includes a lip sloping radially inwardly and downwardly towards the conical impact surface.

20 Claims, 6 Drawing Sheets

(56) References Cited

U.S. PATENT DOCUMENTS

| | | | | | |
|---|---|---|---|---|---|
| 5,072,916 | A * | 12/1991 | Soofi | B22D 41/003 266/275 |
| 5,358,551 | A | 10/1994 | Saylor | |
| RE35,685 | E | 12/1997 | Schmidt et al. | |
| 6,929,775 | B2 * | 8/2005 | Connors, Sr. | B22D 41/003 222/594 |
| 6,997,361 | B2 | 2/2006 | Zacharias et al. | |
| 7,004,227 | B2 | 2/2006 | Xu et al. | |
| 7,128,247 | B2 * | 10/2006 | Retschnig | B22D 11/103 222/594 |
| 8,066,935 | B2 | 11/2011 | Drambarean | |

FOREIGN PATENT DOCUMENTS

| | | | | |
|---|---|---|---|---|
| DE | 202005004118 | U1 | 8/2005 | |
| DE | WO 2006094584 | A1 * | 9/2006 | B22D 41/003 |
| EP | 0847821 | A1 | 6/1998 | |
| EP | 0847313 | B1 | 10/1999 | |
| EP | 1567297 | B1 | 3/2007 | |

OTHER PUBLICATIONS

EPO machine translation of EP 0184634 A1, Jun. 18, 1986.*

Chattopadhyay et al, "Physical and Mathematical Modelling of Steelmaking Tundish Operations: A Review of the Last Decade (1999-2009)", ISIJ International, 2010, pp. 331-348, vol. 50, No. 3.

International Search Report and Written Opinion, corresponding International Application No. PCT/US2015/045513, Nov. 26, 2015.

* cited by examiner

IMPACT PAD, TUNDISH AND APPARATUS INCLUDING THE IMPACT PAD, AND METHOD OF USING SAME

CROSS-REFERENCE TO RELATED APPLICATIONS AND CLAIM OF PRIORITY

This application is a continuation of U.S. application Ser. No. 14/510,789, now U.S. Pat. No. 9,308,581 which claims the benefit of priority of U.S. Provisional Application No. 62/037,949 filed Aug. 15, 2014 and U.S. Provisional Application No. 61/971,876 filed Mar. 28, 2014, the complete disclosures of which are incorporated herein by reference and the benefits of priority of which are claimed herein.

FIELD OF THE INVENTION

This invention relates to impact pads used in steelmaking, especially to tundish impact pads adapted to reduce turbulence and bath surface disruption generated by a molten steel ladle stream fed into a continuous caster tundish. The invention further relates to tundishes and apparatus including the impact pads, and methods of using the impact pads, tundishes, and apparatus.

BACKGROUND

A steel caster is an apparatus for carrying out continuous casting, also referred to in the art as strand casting. Continuous casting involves transferring molten steel from a steelmaking furnace into a ladle. From the ladle, the molten steel is fed through a shroud of the ladle (also referred to as a ladle shroud) extending into a container or vessel referred to as a tundish. The molten steel typically is fed at a continuous or semi-continuous liquid flow into a molten steel bath contained in the tundish. The tundish typically acts as a reservoir from which the molten steel may be fed, without interruption or unwanted downtime, into caster molds. In order to protect the molten steel in the tundish from unwanted chemical reaction, e.g., excessive oxidation, and air-borne particulates, a protective slag cover/layer or "flux" is allowed to form at the surface of the molten steel bath.

Surface requirements and cleanliness standards of modern high quality steel products allow for very low tolerances of impurities and chemical changes. Impurities and chemical changes often are the result of turbulence created by the incoming ladle stream of molten steel fed into the tundish. Certain tundish designs for receiving liquid steel from the ladle shroud lead to unfavorable fluid flow conditions, such as turbulence, inside the tundish and promote high free surface flow activities. For example, the fluid flow generated by an incoming ladle stream may be reflected from the flat tundish floor and sidewalls toward the surface of the liquid steel. This generated fluid flow causes a turbulent boiling action, extensive wave motion, and splashing at the surface of the steel bath.

For example, FIG. 10 illustrates a longitudinal cross section of a single strand tundish 1 having an asymmetrical fluid flow 9*a*. The ladle shroud 7 is shown adjacent end wall 3 opposite a well block (not shown in FIGS. 10 and 11). Water flow-model studies have shown that the fluid flow, generated by an incoming ladle stream 8 from the ladle shroud 7, is reflected from the flat tundish floor 4 in an upward direction toward the surface of the liquid steel. If this fluid flow is restricted by the tundish walls 2 and 3, the restricted fluid flow is forced upward along the surface of such walls 2, 3. This upward flow follows a circular path 9*c*, and creates an upward surge along the face of the end wall 3, and a downward flow around a ladle shroud 7. The upward surge of the circular flow 9*c* causes excessive turbulence at the surface of the bath. These high free surface activities in the tundish give rise to a phenomenon called "open-eye," whereby the protective slag cover 6 on top of the steel bath is broken. The broken slag cover 6 exposes the liquid steel to the surrounding atmosphere and sets up conditions conducive to altering the chemistry of the steel bath and creating inclusions in the steel bath. The chemical changes typically involve loss of aluminum from the bath and/or absorption of oxygen and nitrogen into the steel bath and consequent surface re-oxidation. Re-oxidation and other undesired reactions can introduce, for example, excess alumina, manganese sulfide, and calcium sulfide into the steel bath. Additionally, the downward flow around the ladle shroud 7 generates shear and vortices, and entraps and pulls broken particles 10 from the broken flux cover 6 down into the liquid steel bath. These broken particles 10 eventually are discharged from the tundish with the molten steel and create inclusions within the finished steel product.

The chemical changes and inclusions ultimately reduce steel quality and are a primary cause of rejection of high value steel grades such as HIC and armor plate grades. Further, splashing of the high temperature liquid steel against the tundish walls may present safety hazards for operators. Using conventional equipment, problems can also arise with respect to lack of steel bath temperature homogeneity and insufficient residence time to allow inclusion particles to float to the protective slag cover, where the particles can be isolated and/or separated from the liquid steel.

There have been various attempts to reduce or eliminate surface turbulence within a continuous caster tundish to improve the quality of the finished steel product. These attempts have included a wide assortment of dams and weirs which redirect the ladle stream fluid flow away from the surface of the molten steel bath. Although some known fluid flow control devices have been somewhat successful in controlling fluid flow and reducing surface turbulence, such control devices tend to be insufficient for the demands of high quality steel and/or cause operational problems such as those described above.

SUMMARY OF THE INVENTION

According to a first aspect of the invention, a tundish impact pad is provided that features a base having a base surface with a conical impact surface area that establishes an apex, a sidewall, and a top wall extending inwardly relative to the sidewall to terminate an inner edge establishing a mouth opening spaced above and centered relative to the apex. The top wall includes a lip sloping radially inwardly and downwardly towards the conical impact surface.

A second aspect of the invention provides an apparatus featuring a continuous caster tundish for containing a reservoir of molten metal having fluid flow generated by an incoming ladle stream, and a tundish impact pad in the continuous caster tundish. The tundish impact pad includes a base having a base surface with a conical impact surface area establishing an apex, a sidewall, and a top wall extending inwardly relative to the sidewall to terminate at an inner edge establishing a mouth opening spaced above and centered relative to the apex. The top wall includes a lip sloping radially inwardly and downwardly towards the conical impact surface.

A third aspect of the invention provides a strand casting method or molten steel processing method in which an incoming ladle stream of molten liquid steel is fed into a continuous caster tundish and impacted against a conical impact surface area of the tundish impact pad before being allowed to flow through a mouth opening of the tundish impact pad and into a tundish reservoir. The tundish impact pad includes a base having a base surface, a sidewall, and a top wall extending inwardly relative to the sidewall to terminate at an inner edge establishing the mouth opening spaced above and centered relative to an apex of the conical impact surface area. The top wall includes a lip sloping radially inwardly and downwardly towards the conical impact surface.

In accordance with an embodiment of each of the aspects described herein, the top wall of the tundish impact pad features a lower surface that, collectively with the base surface and a continuous inner surface of the sidewall, establish a continuous annular chamber configured to reduce turbulence of an incoming ladle stream of molten liquid steel.

In accordance with another embodiment of the above aspects, the conical impact surface area has an axis, passing through the apex, about which the conical impact surface area has rotational symmetry.

In accordance with still another embodiment of the above aspects, the conical impact surface area has a linear profile.

In accordance with a further embodiment of the above aspects, the conical impact surface area has a cone angle, measured from a horizontal plane in which an outer perimeter of the conical impact surface area lies to an oblique plane in which the conical impact surface area lies, in a range of about 15 degrees to about 25 degrees.

In accordance with a still further embodiment of the above aspects, the lip has a downward lip angle, measured from a horizontal plane to a lower surface of the lip, in a range of about 20 degrees to about 25 degrees.

According to another embodiment of the above aspects, the continuous annular chamber has a radius of curvature of about 30 mm.

According to still another embodiment of the above aspects, protuberances, for example hemispherical protuberances, are distributed about a lower surface area of the lip.

The above embodiments may be practiced in any combination with one another.

Other aspects and embodiments of the invention, including apparatus, assemblies, devices, articles, methods of making and using, processes, and the like which constitute part of the invention, will become more apparent upon reading the following detailed description of the exemplary embodiments.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings.

Figure 10:
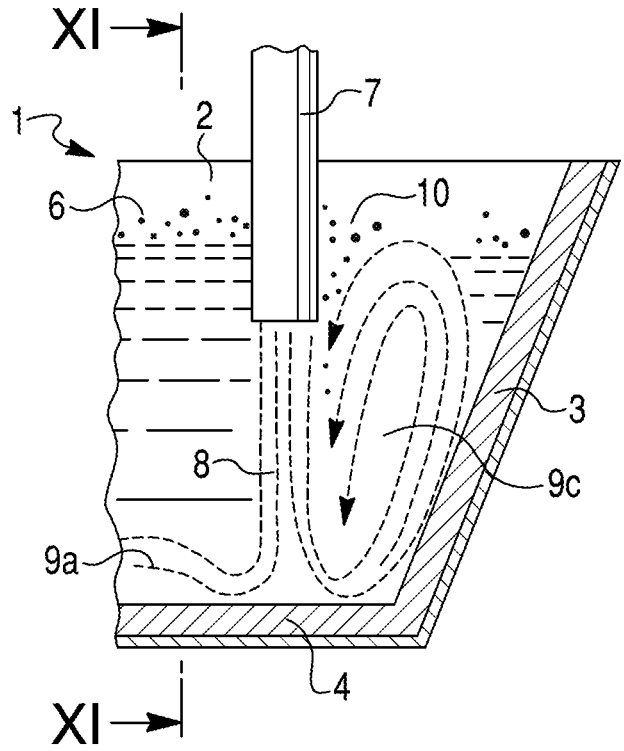
Fig. 10 (Prior Art)
Figure 11:
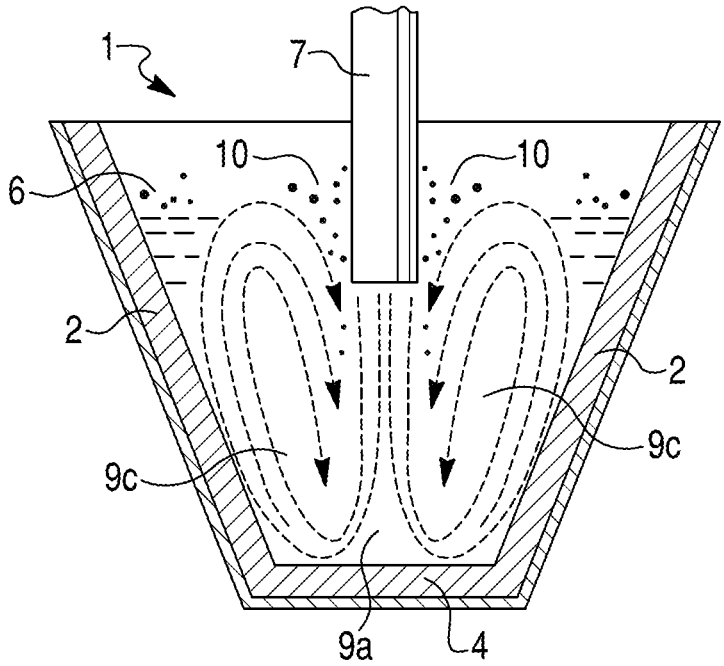
Fig. 11 (Prior Art)

FIGS. 10 and 11 are reproduced from U.S. Pat. No. Re. 35,685, wherein FIG. 10 is a longitudinal cross-sectional view of a water flow-model study tundish and FIG. 11 is a transverse cross-sectional view taken along line XI-XI of FIG. 10.

DETAILED DESCRIPTION OF THE EXEMPLARY EMBODIMENTS AND EXEMPLARY METHODS

Reference will now be made in detail to the exemplary embodiments and methods as illustrated in the accompanying drawings, in which like reference characters designate like or corresponding parts throughout the drawings. It should be noted, however, that the invention in its broader aspects is not necessarily limited to the specific details, representative materials and methods, and illustrative examples shown and described in connection with the exemplary embodiments and methods.

Figure 1:
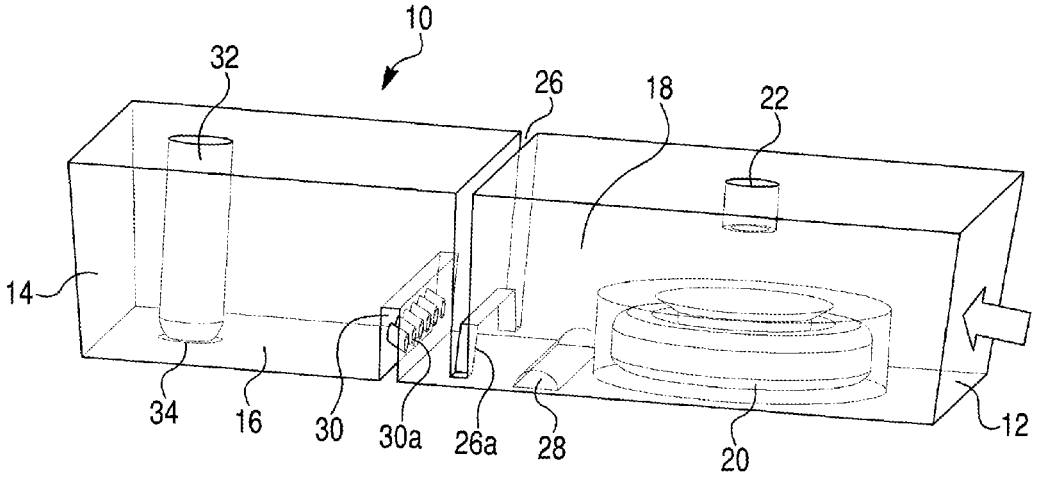
FIG. 1 is a longitudinal cross-sectional front perspective view of a single strand caster tundish including an impact pad according to an embodiment of the invention.
Figure 2:
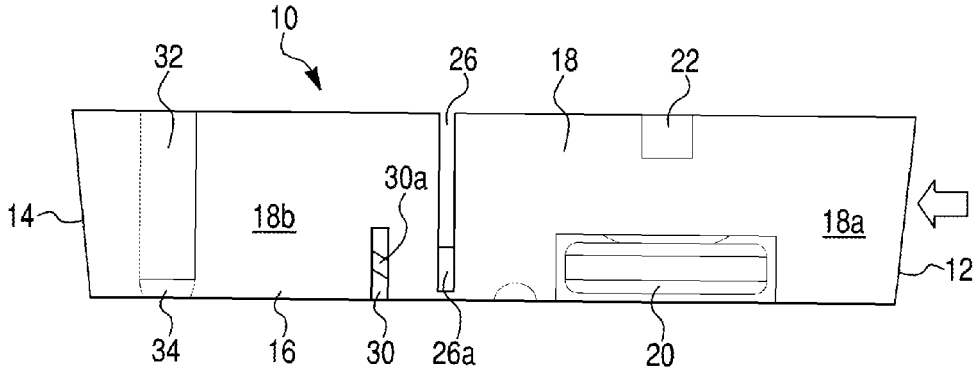
FIG. 2 is a longitudinal cross-sectional front view of the single strand caster tundish of FIG. 1.
Figure 3:
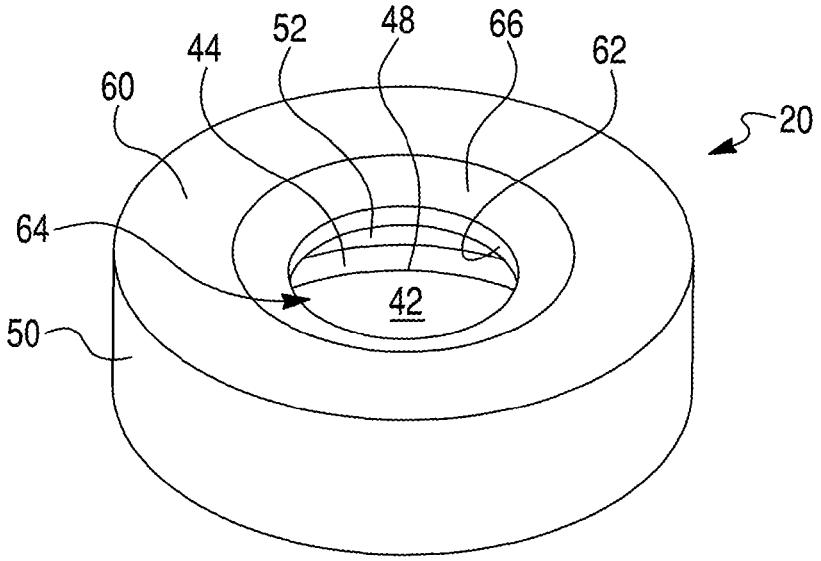
FIG. 3 is a front perspective view of the impact pad of the embodiment illustrated in FIG. 1.

A tundish for a strand caster in accordance with an exemplary embodiment is generally designated by reference numeral 10 in FIGS. 1 and 2. Although a single-strand caster is shown therein, it should be understood that embodiments of the present invention may be practiced in connection with double-strand and other multiple-strand casters. An example of a multi-strand caster setup, albeit with a different impact pad, is shown in FIG. 10 of U.S. Pat. No. RE 35,685. The tundish 10 includes tundish end walls 12 and 14, tundish front and rear sidewalls (unnumbered), and a tundish floor 16 extending between and connected to (or integral with) the end walls 12, 14 and sidewalls. The tundish end walls 12, 14 and floor 16 collectively establish a chamber or reservoir 18 for receiving and holding a molten steel bath. A tundish impact pad 20 is located in the reservoir 18, for example, closer to the end wall 12 than to the end wall 14. Positioned above the tundish impact pad 20 is the lower part of a ladle shroud 22 for introducing an incoming ladle stream 24 (FIG. 7) of molten steel into the impact pad 20. The ladle shroud 22 is shown penetrating through the top of the molten steel bath, with the end of the ladle shroud 22 spaced above and centered coaxially with the tundish impact pad 20. The flow of molten steel and the structure and function of impact pad 20 are discussed in further detail below.

The tundish 10 further includes a weir 26 dividing the tundish 10 into right and left (first and second) compartments 18*a* and 18*b*, respectively, with the impact pad 20 in the right compartment 18*a* on the tundish floor 16 in FIGS. 1 and 2. The bottom of the weir 26 includes a passage 26*a* for allowing fluid communication between the liquid steel in the left and right compartments 18*a*, 18*b*. A diffuser 28 is positioned on the tundish floor 16 in the right compartment 18*a* between the weir 26 and the tundish impact pad 20. A dam 30 having a plurality of upwardly sloping (from right to left in the direction of flow) cylindrical passages 30*a* rests on the tundish floor 16 in the left compartment 18*b*. On the opposite side of the darn 30 from the weir 26, a stopper rod 32 is aligned with an output port or tundish well block 34 through which liquid steel is discharged from the tundish 10. Upward and downward movement of the stopper rod 32 controls outflow of molten steel from the tundish 10 and into casts (not shown).

The tundish impact pad 20 may be made of a material or materials suitable for the intended use in a caster tundish for molten steel processing. Typically, such material(s) have high impact and abrasion resistance, high hot strength and refractoriness, and good castability. Metals, ceramics, and sand with ceramic coatings are examples of suitable materials. As specific but non-limiting examples, low-moisture, high-alumina castable compositions such as Narcon 70 Castable and coarse high alumina low cement castable compositions such as Versaflow® 70C Plus are refractory materials suitable for use as the tundish impact pad 20. According to product literature: Narcon 70 Castable contains (calcined basis) 26.9% silica ($SiO_2$), 69.8% alumina ($Al_2O_3$), 1.7% titania ($TiO_2$), 0.8% iron oxide ($Fe_2O_3$), 0.7% lime (CaO), and 0.1% alkali ($Na_2O$); and Versaflow® 70C Plus contains (calcined basis) 27.5% silica ($SiO_2$), 67.3% alumina ($Al_2O_3$), 2.1% titania ($TiO_2$), 1.2% iron oxide ($Fe_2O_3$), 1.6% lime (CaO), 0.1% magnesia (MgO), and 0.2% alkalis ($Na_2O+K_2O$). The body parts of the tundish impact pad 20 can be coated with an erosion resistant material to form erosion resistant coatings for receiving and coming into contact with the incoming ladle stream 24. The erosion resistant coatings may be made with medium emissivity materials (such as Zirconia, Yttria, Silicon Carbide), high reflectivity materials (such as aluminum and alumina), or high temperature, non-oxide lubricants (such as boron nitride).

Figure 4:
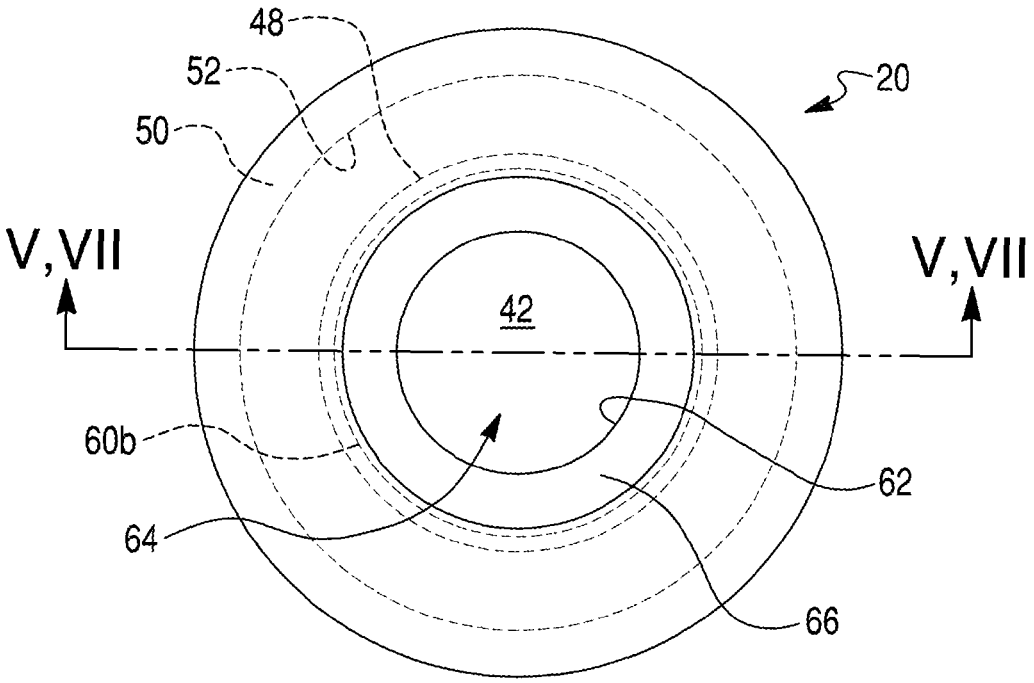
FIG. 4 is a plan view of the impact pad of FIG. 3.
Figure 5:
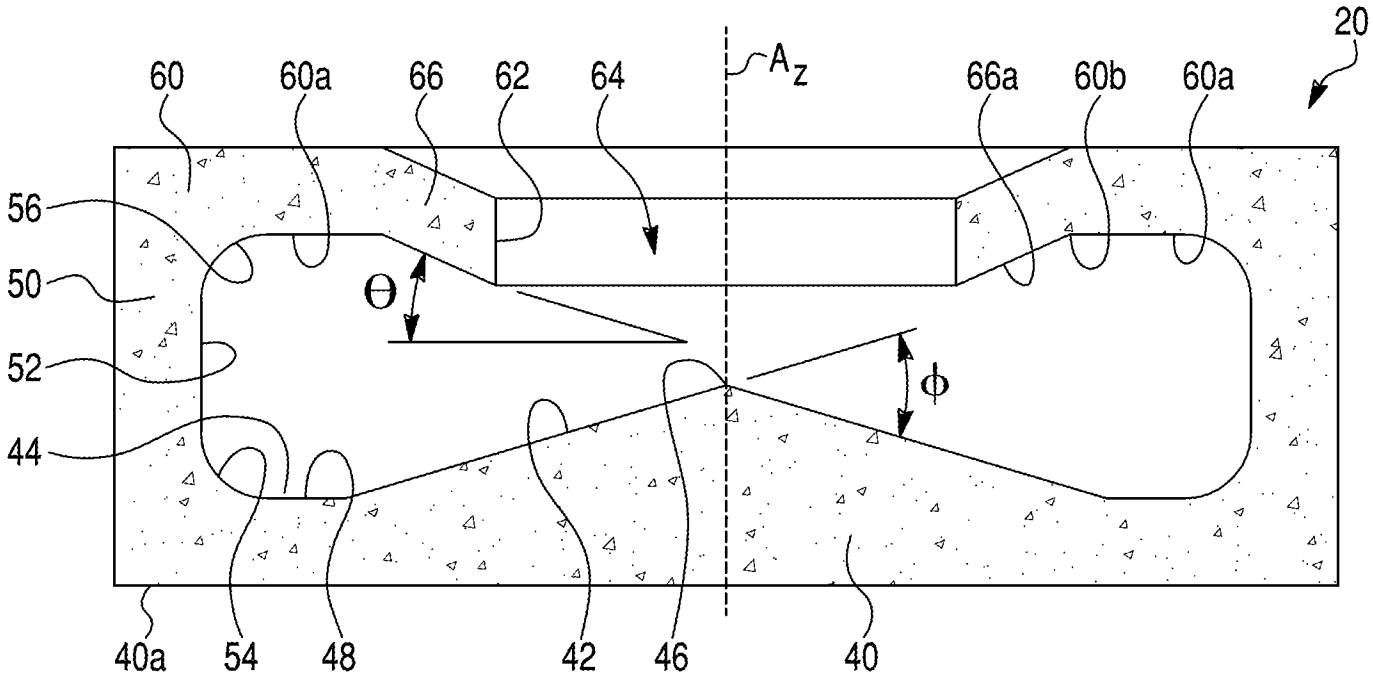
FIG. 5 is a cross-sectional view taken along the line V-V of FIG. 4.
Figure 6:
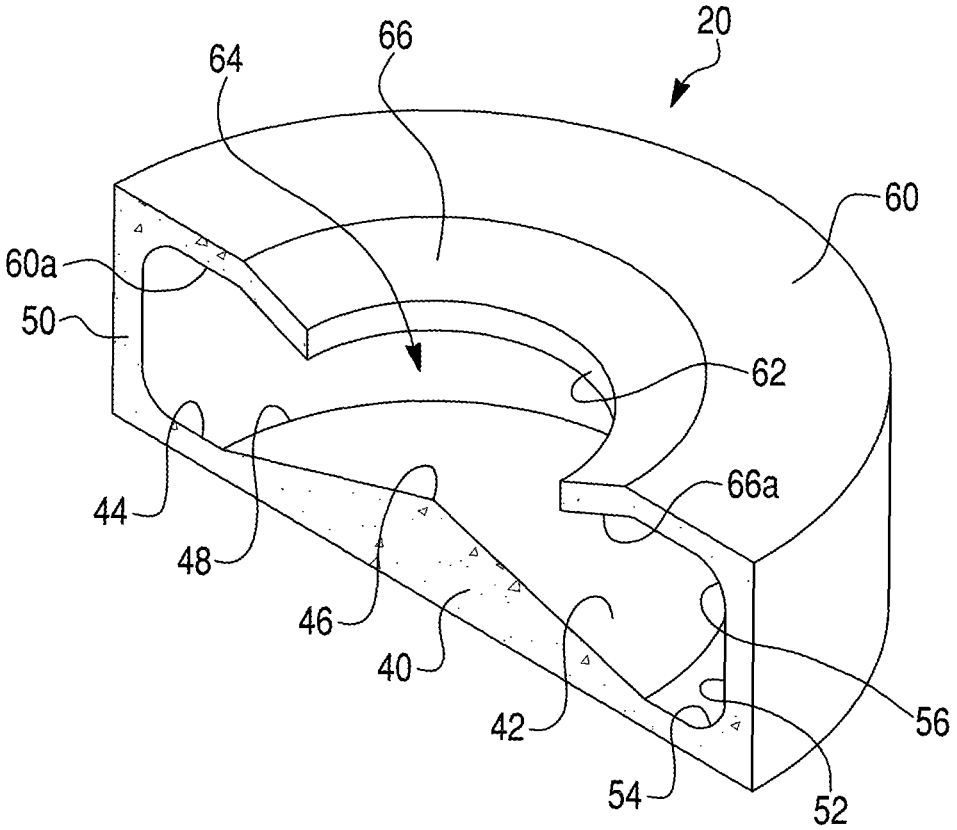
FIG. 6 is a cut-away side perspective view of the impact pad of FIGS. 3-5.

Referring to the embodiment shown in FIGS. 3-6, the tundish impact pad 20 includes a circular base 40 (relative to a plan or bottom view). The base 40 includes a top base surface having a conical impact surface area 42 and an adjoining, adjacent annular base surface area 44 concentrically surrounding the conical impact surface area 42. In the illustrated embodiment, the conical impact surface area 42 is not truncated. Optionally, the top of the conical impact surface area 42 may be slightly rounded while still retaining the conical shape. As best shown in FIG. 5, the conical impact surface area 42 extends upwardly to terminate at an apex or vertex 46. The conical impact surface area 42 has rotational symmetry about an imaginary axis Az (FIG. 5) passing through the apex 46. In the illustrated embodiments, the conical impact surface area 42 has a linear profile or cross section, as best shown in FIG. 5. The bottom of the linear profile of the conical impact surface area 42 terminates at an outer perimeter 48 adjacent to and contiguous with a radially inner edge of the annular base surface area 44. The top of the linear profile of the conical impact surface area 42 terminates at a point corresponding to the apex 46 that is coincident with the axis Az. The annular base surface area 44 may be at least partially flat and lie in a horizontal plane that is parallel to the bottom surface 40*a* of the base 40.

The tundish impact pad 20 further includes a sidewall 50 having a sidewall inner surface 52 that continuously/endlessly circles on itself to appear as an annulus when viewed from above, as in FIG. 4. The sidewall 50 is shown having uniform thickness over its entire 360 degrees. The sidewall inner surface 52 is positioned concentrically outside of and generally perpendicular to the annular base surface area 44. As best shown in the cross-sectional view of FIG. 5, the sidewall inner surface 52 includes curved transition areas 54, 56 at its bottom and top, respectively. The curved transition areas 54, 56 may he symmetrical to one another. The ends of the lower curved transition area 54 are flush and contiguous with the annular base surface area 44 and the sidewall inner surface 52. The lower curved transition area 54 curves continuously between the base 40 and the sidewall inner surface 52.

The tundish impact pad 20 still further includes a top wail 60 extending inwardly from the top transition area 56 and generally perpendicular to the sidewall 50 to terminate at an inner edge 62. The top transition area 56 is configured as a curvilinear undercut that curves continuously between and whose ends are flush and contiguous with the sidewall inner surface 52 and the top wall 60. A mouth opening 64 established by the inner edge 62 is spaced above and centered relative to the apex 46. In use, the mouth opening 64 is under and coaxial with the ladle shroud 22 to receive the incoming ladle stream 24. In the illustrated embodiments, the diameter of the mouth opening 64 is approximately equal to or less than the diameter of the outer perimeter 48 of the conical impact surface area 42.

The top wall 60 includes a lip 66 angled inwardly and downwardly to terminate at the inner edge 62. The top wall 60 has a first lower surface area 60*a* that extends substantially horizontally and parallel to the bottom surface 40*a* and a second lower surface area (also referred to herein as a lower lip surface) 66*a* corresponding to the bottom of the lip 66. The lover lip surface 66*a* slopes radially inwardly and downwardly from the first lower surface area 60*a* towards the conical impact surface 42. As best shown in FIGS. 4 and 5, the first lower surface area 60*a* and the lower lip surface 66*a* interface at 60*b*.

The base 40, side wall 50, and top wall 60 may be integral, that is a unitary piece or monolithic part. Alternatively, the base 40, the sidewall 50, the top wall 60 and/or other parts of the tundish 10 may be formed of separate pieces temporarily or permanently joined to one another. The conical impact surface area 42, the annular base surface area 44, the continuous sidewall inner surface 52, the curved transition surface areas 54, 56, and the lower surface areas 60*a*, 66*a* collectively establish a continuous annular chamber about axis Az that may be in the form of a torus.

Figure 7:
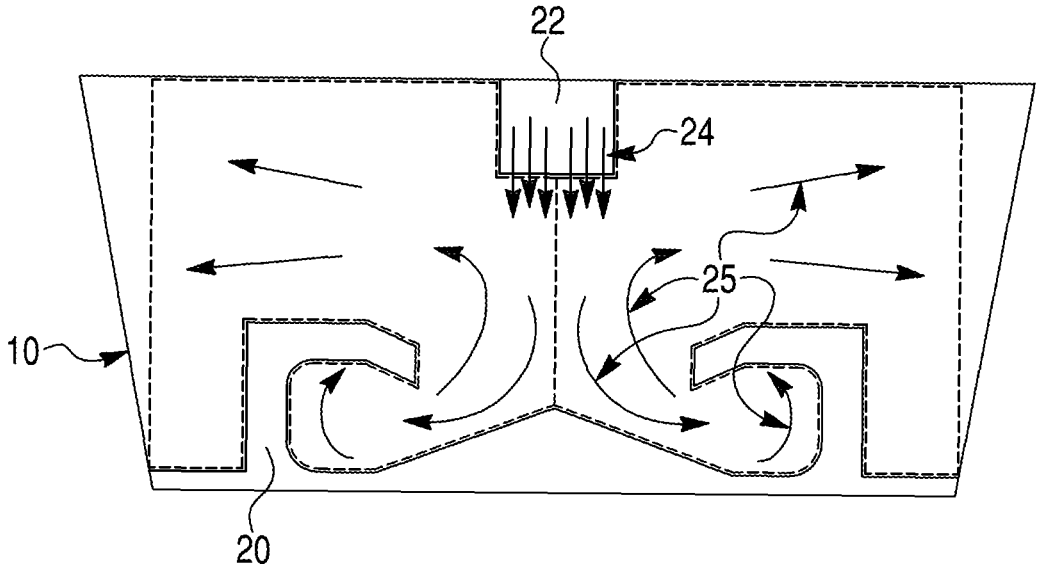
FIG. 7 is a cross-sectional end view taken from the view point of the arrow on the right side of FIGS. 1 and 2, showing the flow profile of incoming liquid steel introduced through a shroud centered above the impact pad.

Referring to FIG. 7, liquid steel is introduced into the tundish 10 through the shroud or sprue 22 as the incoming ladle stream 24. It has been found that the ratio ($D_j/D_m$) of the diameter $D_j$ of the inner diameter of the shroud 22 to the diameter $D_m$ of the mouth opening 64 in a range of about 0.3 to about 0.4 provides particularly good results. The ladle shroud 22 and the mouth opening 64 are coaxially aligned with one another in the exemplary embodiment. The design of the exemplary embodiments described herein causes the incoming ladle stream 24 to impact against the conical impact surface area 42, which redirects the stream 24 radially outward towards the lower transition portion 54 and the sidewall inner surface 52. The shape of the continuous annular chamber forces the molten steel flow into a reversed direction back towards the incoming ladle stream 24 to reduce the turbulence and dissipate the energy of the molten steel before it flows from the impact pad 10. The reversed fluid flow is discharged upward through the mouth opening 64, then generally radially outward in all directions towards the walls of the tundish 10 as a substantially laminar flow. By providing a mouth opening 64 that is greater in diameter than the diameter of the shroud 22, an annular upward flow is created between the incoming ladle stream 24 and the inner edge 62.

The molten steel exits the mouth opening 64 into the first compartment 18*a*. The continuous inflow of the incoming ladle stream and removal of molten steel through the outlet 34 causes the molten steel in compartment 18*a* to flow towards the weir 26 and through the weir passage 26*a*. After passing through the weir passage 28, the molten steel flows over the dam 30 and/or through the cylindrical passages 30*a* before being discharged through the output 34.

The reversing of molten steel flow onto itself creates a self-braking effect. As a consequence, the outgoing flow of molten steel through the mouth opening 64 and into the first compartment 18*a* is less turbulent and has less energy. The above-described "open-eye" and splashing problems are thereby reduced significantly.

In a particularly exemplary embodiment designed to suppress "open-eye," the conical impact surface area 42 has a cone angle $\phi$ (FIG. 5), measured from a horizontal plane in which the outer perimeter 48 lies to an oblique plane in which the conical impact surface area 42 lies, in a range of about 15 degrees to about 25 degrees. In another particularly exemplary embodiment designed to suppress "open-eye," the lip 66 has a downward lip angle theta ($\theta$), measured from a horizontal plane to a plane in which the lower surface 66*a* of the lip 66 lies, in a range of about 20 degrees to about 25 degrees. In another particularly exemplary embodiment designed to suppress "open-eye," the continuous annular chamber has a radius of curvature of about 30 mm. These exemplary embodiments may be practiced separately or together with one another in any combination. The impact chamber may be provided with a height that is equal to or greater than the inside diameter of the shroud to affect flow control.

Computational fluid dynamics (CFD) simulations were performed on impact pads designed in accordance with the above parameters. The area average velocity, which is a measure of flow activity on the pouring side of the top surface of the steel bath, is calculated to be about 50% lower practicing an embodiment of the invention compared to a flat petal-shaped impact pad. The probability of "open-eye" formation is also calculated to be reduced by the same proportion. Using CFD analysis, in which velocities and areas are calculated for cells of a mesh and area average velocity, area average velocity is determined as follows:

$$\text{area average velocity (m/s)} = \Sigma V \Delta A / \Sigma \Delta A.$$

Generally, it is found that higher area average velocities correspond to greater tundish flux entrainment and poorer quality steel, whereas lower area average velocities correspond to lesser tundish flux entrainment and higher quality steel. Thus, a decrease of about 50% area average velocity constitutes a significant decrease in tundish flux entrainment and leads to higher quality steel products. Without wishing to be bound by theory, it is believed that the improved quality obtained using exemplary embodiments described herein is attributable to one or more of the following: reduction of high velocity incoming flows and turbulence due to the "self-braking" effect; less splash during start-up and continuous operation; longer residence time of the molten steel in the reservoir; promotion of impurity and particle flotation; and more uniform reservoir temperature.

Figure 8:
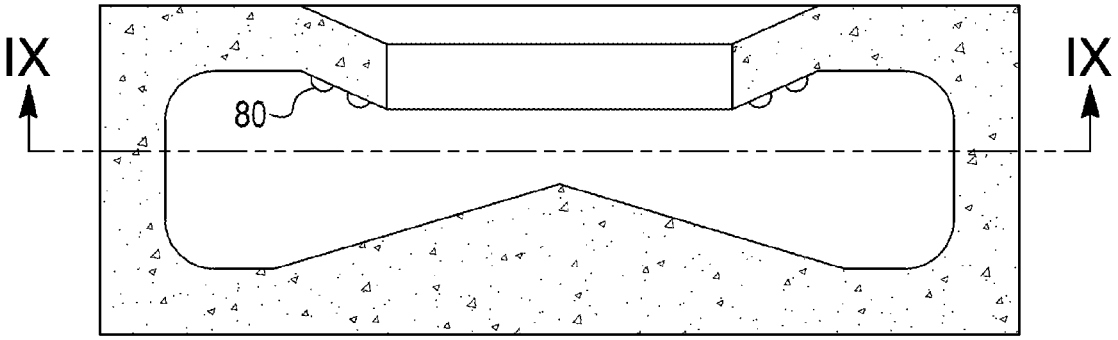
FIG. 8 is a cross-sectional view of an impact pad according to another embodiment of the invention.
Figure 9:
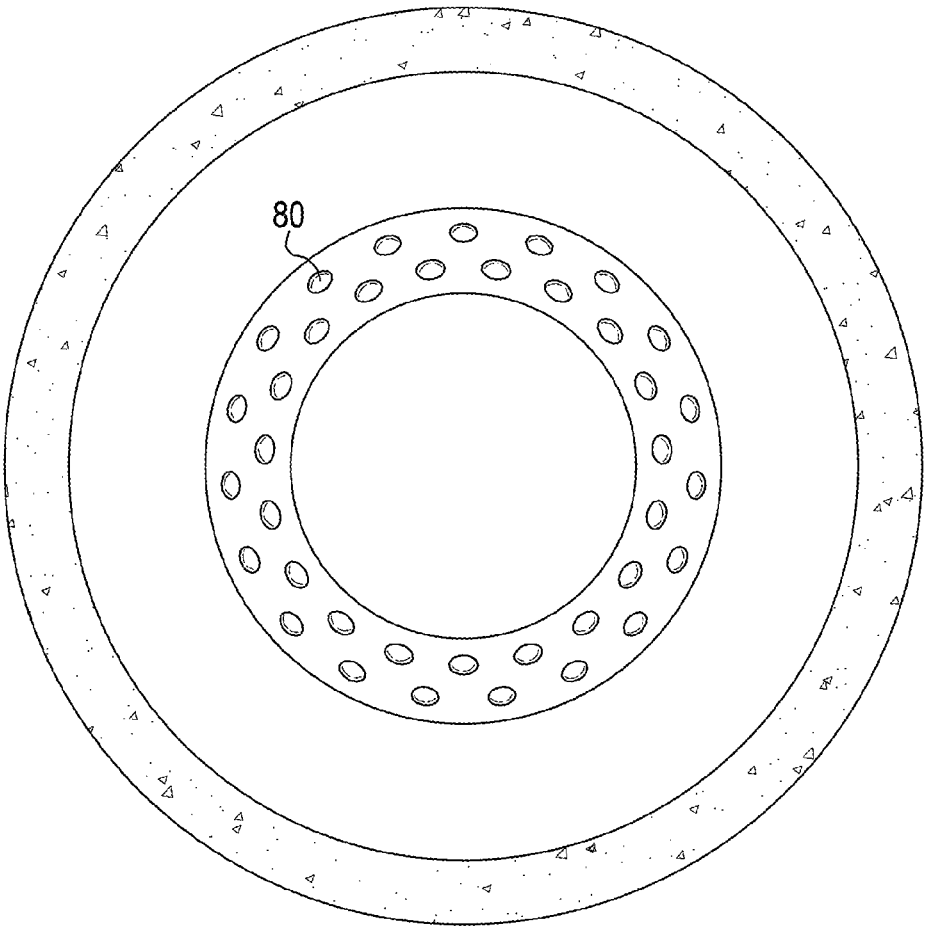
FIG. 9 is a bottom sectional view taken along line IX-IX of FIG. 8.

FIGS. 8 and 9 illustrate an impact pad according to another exemplary embodiment. In the interest of brevity, the following description focuses on differences between the exemplary embodiment of FIGS. 8 and 9 and other exemplary embodiments described above. Like reference characters designate like or corresponding parts in the different exemplary embodiments.

In the exemplary embodiment of FIGS. 8 and 9, protuberances 80 are distributed 360 degrees about the lower lip surface 66*a*. The protuberances 80 may be uniformly distributed, such as in a matrix pattern, or distributed randomly or otherwise. In the illustrated embodiment, the outer surfaces of the protuberances 80 have a hemispherical shape. However, the protuberances 80 may undertake alternative shapes. Moreover, the protuberances 80 may have identical or varying shapes relative to one another. It has been found that the protuberances 80, especially hemispherical protuberances, further decelerate the outgoing flow of liquid steel as it exits the impact pad 20 through the mouth opening 64. Additionally or alternatively, the protuberances 80 may be located elsewhere on the inner surface of the impact pad.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

No limitations from the specification are to be read into any claims unless those limitations are expressly included in the claims.

What is claimed is:

1. A tundish impact pad, comprising:

a base having a base inner surface, the base inner surface comprising a conical impact surface area establishing an apex;

a sidewall having a sidewall inner surface;

a top wall extending inwardly relative to the sidewall to terminate at an inner edge establishing a mouth opening spaced above and centered relative to the apex, the top wall comprising a lip having a lip inner surface sloping radially inwardly and downwardly towards the conical impact surface area; and hemispherical protuberances on the lip inner surface.

2. The tundish impact pad of claim 1, wherein the sidewall inner surface is continuous and radially outward of the base inner surface, and wherein the inner surface of the tundish impact pad establishes a continuous annular chamber configured to reduce turbulence of an incoming ladle stream of molten liquid steel.

3. The tundish impact pad of claim 2, wherein:

the base inner surface further comprises a first flat annular area between the conical impact surface area and the sidewall inner surface;

the top wall comprises a second flat annular area extending between the sidewall inner surface and the lip inner surface; and the first and second flat annular areas are spaced apart from and extend in planes parallel to one another.

4. The tundish impact pad of claim 2, wherein the continuous annular chamber has a radius of curvature of about 30 mm.

5. The tundish impact pad of claim 1, wherein the conical impact surface area has an axis, passing through the apex, about which the conical impact surface area has rotational symmetry.

6. The tundish impact pad of claim 5, wherein the apex comprises a pointed apex, and wherein the conical impact surface area has a linear profile.

7. The tundish impact pad of claim 6, wherein the conical impact surface area has a cone angle, measured from a horizontal plane in which an outer perimeter of the conical impact surface area lies to an oblique plane in which the linear profile of the conical impact surface area lies, in a range of about 15 degrees to about 25 degrees.

8. The tundish impact pad of claim 1, wherein the lip inner surface has a downward lip angle, measured from a horizontal plane to the lip inner surface, in a range of about 20 degrees to about 25 degrees.

9. The tundish impact pad of claim 1, wherein the hemispherical protuberances are located annularly about the lip inner surface.

10. The tundish impact pad of claim 1, wherein:

the apex is a pointed apex and the conical impact surface area has an axis, passing through the pointed apex, about which the conical impact surface area has a linear profile with rotational symmetry;

the conical impact surface area has a cone angle, measured from a horizontal plane in which an outer perimeter of the conical impact surface area lies to an oblique plane in which the linear profile of the conical impact surface area lies, in a range of about 15 degrees to about 25 degrees; and the lip inner surface has a downward lip angle, measured from a horizontal plane to the lip inner surface, in a range of about 20 degrees to about 25 degrees.

11. The tundish impact pad of claim 10, wherein the sidewall inner surface is continuous and radially outward of the base surface, and wherein the inner surface of the tundish impact pad establishes continuous annular chamber configured to reduce turbulence of an incoming ladle stream of molten liquid steel.

12. The tundish impact pad of claim 11, wherein the continuous annular chamber has a radius of curvature of about 30 mm.

13. The tundish impact pad of claim 11, wherein:

the base inner surface further comprises a first flat annular area between the conical impact surface area and the sidewall inner surface;

the top wall comprises a second flat annular area extending between the sidewall inner surface and the lip inner surface; and the first and second flat annular areas are spaced apart from and extend in planes parallel to one another.

14. The tundish impact pad of claim 10, wherein the protuberances are located annularly about the lip inner surface.

15. An apparatus, comprising:

a continuous caster tundish for containing a reservoir of molten metal having fluid flow generated by an incoming ladle stream; and a tundish impact pad within the continuous caster tundish, the tundish impact pad, comprising a base having a base inner surface, the base inner surface comprising a conical impact surface area establishing an apex;

a sidewall having a sidewall inner surface;

a top wall extending inwardly relative to the sidewall to terminate at an inner edge establishing a mouth opening spaced above and centered relative to the apex and positioned to receive the incoming ladle stream, the top wall comprising a lip having a lip inner surface sloping radially inwardly and downwardly towards the conical impact surface area; and hemispherical protuberances on the lip inner surface.

16. The apparatus of claim 15, wherein the protuberances are located about the lip inner surface.

17. The apparatus of claim 15, further comprising:

a weir dividing a chamber of the tundish into a first compartment containing the tundish impact pad and a second compartment associated with an output port, the weir including a passage for communicating the first and second compartments with one another.

18. A strand casting method, comprising:

feeding an incoming ladle stream of molten liquid steel into a continuous caster tundish, the continuous caster tundish containing a tundish impact pad comprising a base having a base inner surface, the base inner surface comprising a conical impact surface area establishing an apex;

a sidewall having a sidewall inner surface;

a top wall extending inwardly relative to the sidewall to terminate at an inner edge establishing a mouth opening spaced above and centered relative to the apex and positioned to receive the incoming ladle stream, the top wall comprising a lip having a lip inner surface sloping radially inwardly and downwardly towards the conical impact surface area; and hemispherical protuberances on the lip inner surface;

impacting the incoming ladle stream of molten liquid steel against the conical impact surface area; and allowing the impacted molten liquid steel to discharge from the tundish impact pad through the mouth opening.

19. A tundish impact pad, comprising:

a base having a base inner surface, the base inner surface comprising a conical impact surface area establishing an apex;

a sidewall having a sidewall inner surface;

a top wall extending inwardly relative to the sidewall to terminate at an inner edge establishing a mouth opening spaced above and centered relative to the apex, the top wall comprising a lip having a lip inner surface sloping radially inwardly and downwardly towards the conical impact surface area; and protuberances located on the lip inner surface.

20. The tundish impact pad of claim 19, wherein the protuberances are located annularly about the lip inner surface.

* * * * *